United States Patent [19]

Ceron et al.

[11] Patent Number: 4,976,123

[45] Date of Patent: Dec. 11, 1990

[54] LOCKS HAVING REMOVABLE BARRELS AND CONTROL TUMBLERS THEREFOR

[75] Inventors: Daniel Ceron, Bastogne; Christian Lodomez, Cherain; Paul Hano, Vaux-sur-Sure; Jose Erard, Martelange, all of Belgium

[73] Assignee: Euro-Locks, S.A.-N.V., Bastogne, Belgium

[21] Appl. No.: 371,194

[22] Filed: Jun. 26, 1989

[30] Foreign Application Priority Data

Jun. 28, 1988 [BE] Belgium ..... 08800736
May 26, 1989 [EP] European Pat. Off. ..... 89870075.2

[51] Int. Cl.[5] ..... E05B 29/02
[52] U.S. Cl. ..... 70/369; 70/371
[58] Field of Search ..... 70/369, 367, 368, 371, 70/370; 224/309, 315

[56] References Cited

U.S. PATENT DOCUMENTS

| | | | |
|---|---|---|---|
| 2,460,709 | 2/1949 | Navarro | 70/369 |
| 3,751,952 | 8/1973 | Rubner | 70/368 |
| 4,386,510 | 6/1983 | Best | 70/369 |
| 4,416,129 | 11/1983 | Trimot | 70/369 |
| 4,672,827 | 6/1987 | Craig | 70/369 |

*Primary Examiner*—Robert L. Wolfe
*Attorney, Agent, or Firm*—Leonard Bloom

[57] ABSTRACT

A key-activated removeable cylinder lock is disclosed. The lock has a lock barrel including a plurality of combinating tumblers disposed therein for movement between a first resting position and a second activated position. The barrel further includes a control tumbler having a first end and a second opposite end. The control tumbler is slidably disposed between a first resting position and a second activated position. In the resting position, the first end is extended relative to the barrel. In the activated position, the first end is retracted relative to the barrel. A housing rotatably removably receives the barrel therein. The housing further has an internal longitudinal slot formed therein extending from a forward end thereof. An annular clearance space is located rearwardly of the slot and is in communicaiton therewith for accommodating extension of the first end of the control tumbler in the resting position, whereby rotational movement of the barrel in the housing is permitted. The width of the first end is greater than the width of the slot and the second end, such that when the control tumbler is in the resting position, removal of the barrel from the housing is prevented. Insertion of a first normal key moves the combinating tumblers into their respective activated positions, whereby the barrel may rotate for the locking and unlocking thereof. Insertion of a second removal key moves the control tumbler into the resting position thereof for the removal of the barrel therefrom.

5 Claims, 8 Drawing Sheets

LOCKS HAVING REMOVABLE BARRELS AND CONTROL TUMBLERS THEREFOR

FIELD OF THE INVENTION

The present invention relates to key-activated cylinder locks and control tumblers therefor and, in particular, to key-activated cylinder locks comprised of a housing, a removable cylinder or barrel, and sliding tumblers, and control tumblers therefor.

BACKGROUND OF THE INVENTION

In the context of everyday life and due to the mobility of persons and objects, the desirability has increased to lock places and objects for preventing unauthorized access to, employment or removal thereof.

Such is the case, for example, the leisure time sporting goods articles, such as skis, sailboards, bicycles, canoes, etc. These articles are often transported on the roofs of motor vehicles, being fixed to a transporter system (commonly known as "load carriers") having a framework including a combination of feet and bars. Examples of such transporter systems are boat carriers, luggage carriers, box load carriers, ski racks and roofracks. For reasons of security, when utilizing such transporter systems it is advantageous to lock both the objects being transported, as well as the transporter system, with locks that are uncumbersome and reliable.

Such is also the case, for example, in the automotive field, with caravans or boats where wheels, gas caps, knobs, deflectors, outboard motors etc. are advantageously locked. If the case arises, such locks can be in the form of individual locking cables.

Comparable applications are also currently found where apartments, security apparatuses, shared industrial installations, office furnishings, etc., are involved. In many of these cases, locks having housings, barrels and sliding tumblers are used for locking, thereby restricting access thereto, and utilization thereof, to authorized persons.

A considerable inconvenience of these systems results from the requirement that, for each individual lock used, a respective key is needed that is matched thereto. In cases where several locks are utilized (such as with the racks and carriers noted above), this results in the user having to carry and maintain numerous keys. Unfortunately, such keys are readily susceptible to being lost. Also, the provision of several keys presents the user with problems of choosing the correct key for each lock, so that often several different keys have to be tried before the correct key is located.

Alternatively, to avoid the inconveniences posed by the necessity of using a plurality of keys, a combination of locks are sometimes employed that function (are locked and unlocked) with a sole, common key.

Finally, in order to provide flexibility in systems utilizing a common key and to permit one or more of the individual locks to be replaced when desired, it has been proposed to provide locks in which the barrels thereof are removable from the housing. In these arrangements, the barrel is retained in the housing by a tumbler that is in the form of a control tumbler. When eccentrically displaced under the action of a spring, this control tumbler projects outwardly from the substantially cylindrical barrel (so that the control tumbler is extended relative to the barrel) and collaborates with a stop or a shoulder (wall) defined by a groove formed in the housing for preventing the removal of the barrel from the housing. The shape of this control tumbler is such that when an appropriate tool or key is introduced, the control tumbler is returned into a centric position in which it no longer projects from the cylindrical barrel (so that the control tumbler is retracted relative to the barrel). The barrel may then be removed from the housing concommittantly with, and simply by the pulling of, the tool Thus removed, the barrel is able to be replaced by another barrel which then makes up a part of the combination of locks that use the common key.

Although the barrels of the independent locks are thereby permitted to be easily unlocked and/or replaced, as desired or needed, by other barrels that use the common key, this system can nonetheless be disadvantageous from a security viewpoint. Anyone equipped with an appropriate tool is, in the event that only one key is provided, able to both unlock and dislodge (remove) any of the barrels of any of the locks of this type of system. In the event that the system is of the type that utilizes a first common key for locking and unlocking functions and a second key for removal functions, then anyone equipped even with only an appropriate second key (which is often a key that has simplified contours and, as such, is readily susceptible to being counterfeited) is still able to dislodge and remove any of the barrels of the locks of the system, regardless whether the locks are locked or unlocked.

U.S. Pat. No. 2,061,456 issued to Falk attempts to solve these problems by providing a lock having a removable barrel with a control tumbler in which an extending end thereof is always extended relative to the barrel. The extending end has a pair of opposite rounded shoulders, so that the width of the extending end is reduced relative to the remainder of the control tumbler. When in the locking position, the extending end abuts a wall or shoulder formed in the barrel. In an unlocking position, the extending end coacts with slanted edges of a longitudinal slot, permitting removal of the barrel. In this fashion, the barrel can only be removed from the housing when the barrel is in the unlocked position.

U.S. Pat. No. 4,398,405 issued to Patriquin, attempts to solve these problems by providing a lock having a removable barrel equipped with a control tumbler that, in one position, has a first end extended, and a second end retracted, relative to the barrel. In another position, the first end is retracted, and the second end is extended, relative to the barrel. The extending end of the control tumbler is either the same width throughout its entire length or (like Falk '465) it is reduce din width relative to the remainder of the control tumbler. When an appropriate end is received in an annular groove so as to be aligned with a longitudinal slot, the barrel may be removed.

While each of the above disclosures is useful for its intended purposes, they also have several disadvantages. Among these are that in order to operate properly, at least one of each pair of matched longitudinal slots must terminate short of the annular groove while the other slot of the pair is in communication with the annular groove. Such an arrangement requires specialized tooling of the housing and/or the placement of specialized stops and inserts in the housing. This creates significant problems in manufacturing standardization and requires an increase in parts and inventories. Another disadvantage is the shape of the control tumblers. Because these tumblers are often fabricated from steel and brass while the barrels and housings are fabricated from a die cast zinc alloy, these parts are readily subject to deformation resulting from overpushing of the key, overpulling of the barrel, etc. Despite this, in the disclosures, the extending ends of the control tumblers (which is the portion of the control tumblers which subjects the barrel and the housing to the greatest amount of the stress) are either reduced in width, or at the most, are the same width throughout. Such an arrangement does nothing to spread the stress over as great an area an possible, so as to strengthen the said control tumbler and to reduce the likelihood of the deformation thereof.

Additionally, in Patriquin '405, to provide an appropriate annular groove, an arrangement is disclosed wherein the groove is open to the environment. Such a feature is not adaptable for use in locks having exterior applications, where it is exposed to the elements, such as snow, rain, etc., that can enter the internal workings thereof via the groove, damaging the workings of the lock. Also, the arrangements of Patriquin ∝405 require that different types of control tumblers and longitudinal slots be utilized depending on whether the barrel of the lock is to be rotatable 90°, 180°, 360°, etc. This creates problems not only with manufacturing standardization, but also requires that a considerable inventory of parts, for the various tumblers, etc., of the locks be maintained.

Thus, it can be seen that there remains a need for a lock and a control tumbler therefor, in which the barrel is removable therefrom only when in the unlocked position, which is capable of being fabricated so that it does not present problems with manufacturing standardization and maintenance of parts inventory, and which provides an improved control tumbler that is capable of withstanding greater amounts of stress than those of the prior art.

SUMMARY OF THE INVENTION

Accordingly, it is the primary object of the present invention to remedy the above-noted inconveniences, by providing locks having a housing, a removable barrel and sliding tumblers, in which the removable barrel may be easily installed or replaced with the use of a simple tool (such as a removal key), only after first unlocking of the lock with a separate normal key.

It is another primary object of the present invention to provide a lock which can be easily fabricated without encountering problems with manufacturing standardization, and which utilizes standardized parts that are adaptable for use in a wide variety and range of locks, thereby reducing problems with inventory.

It is still another primary object of the present invention to provide an improved control tumbler that is capable of always sliding freely and avoiding the build up of the amounts of stress to which these locks are often subjected, while simultaneously facilitating the manufacture standardization of the lock in which the control tumbler is utilized.

It is another object of the present invention to provide such a lock wherein the barrel is able to rotate for the locking and unlocking thereof and wherein a control tumbler is provided that permits rotation of the barrel in the housing while simultaneously preventing removal thereof.

It is still another object of the present invention to provide such a lock wherein the barrel is not able to rotate for the locking and unlocking thereof when the control tumbler is positioned, so as to permit removal of the barrel from the housing.

It is a yet further object of the present invention to provide a lock having a control tumbler which retains the barrel in the housing, so that the barrel cannot be partially dislodged from the housing during locking and unlocking operations.

It is a still yet further object of the present invention to provide a lock which is simple to manufacture and does not require inserts or piece for abutment, even when a 360° annular rotation of the annular groove is provided.

In accordance with the teachings of the present invention, there is disclosed a control tumbler for a key activated removable cylinder lock. The control tumbler is of the type that has a first end that is extended relative to the barrel in a resting state and that is retracted relative to the barrel in the activated state. If desired, this tumbler also may have a second end that may be extended relative to the barrel in the activated state. The improvement upon this arrangement is the first end has a width that is greater than the width of the second end and/or the width of any longitudinal slot formed in the housing, such that removal of the barrel having the control tumbler in the resting state is not accommodated by the housing. This prevents the removal of the barrel from the housing when the control tumbler is in the resting state. This arrangement also provides the control tumbler with a greater surface area, thereby enabling the control tumbler to withstand the greater stress to which it may be subjected.

In another aspect of the present invention, a key-activated removable cylinder lock is provided that includes a lock barrel, a housing (a lock barrel housing), combination tumblers and the control tumbler. The lock barrel has a plurality of combinating tumblers disposed therein for movement between respective first resting positions and respective second activated positions. The barrel further has the control tumbler disposed therein for movement between a first resting position, wherein a first end of the control tumbler is extended relative to the barrel and a second position, wherein the first end of the control tumbler is retracted relative to the barrel. Means is provided for biasing the control tumbler into one of the two positions thereof. The housing is provided having a bore formed therethrough for rotatably receiving the barrel therein. The housing further has an internal longitudinal slot formed therein extending from a forward end of the housing and being in open communication with the bore for accommodating the extension of the combinating tumblers in resting positions, such that the barrel cannot be rotated. The housing further includes an annular clearance space located rearwardly of the slot for accommodating extension of the control tumbler in the resting position thereof, whereby rotational movement of the barrel in the housing is permitted. The width of the first end of the control tumbler is greater than the width of the slot, such that the slot does not accomodate the first end. In this manner, when the control tumbler is in the resting position, removal of the barrel from the housing is prevented. Finally, insertion of a removal key into the barrel slidingly moves the control tumbler into the activated position permitting removal of the barrel from the housing.

In other aspects of the present invention the locks and the control tumblers are incorporated for use in load carriers and in box carriers.

These and other objects of the present invention will become readily apparent from a careful reading of the following specification taken in conjunction with the enclosed drawings.

DESCRIPTION OF PREFERRED EMBODIMENTS

Figure 1:
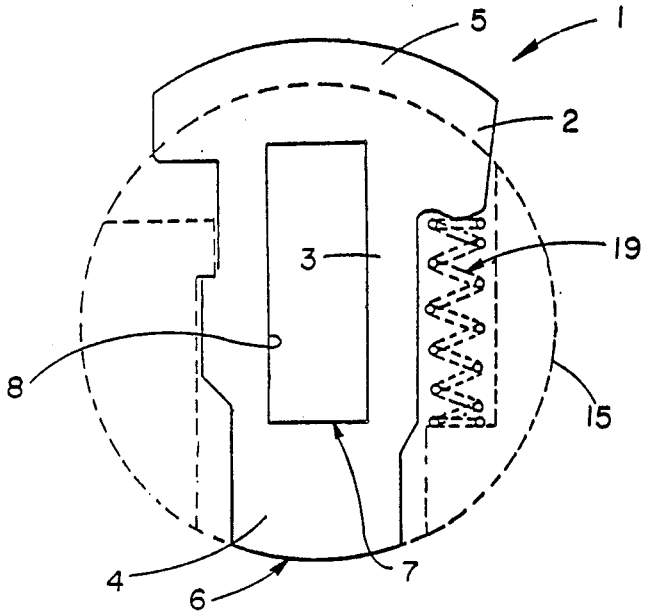
FIG. 1 is an elevated view of a control tumbler of the present invention in the resting position.
Figure 2:
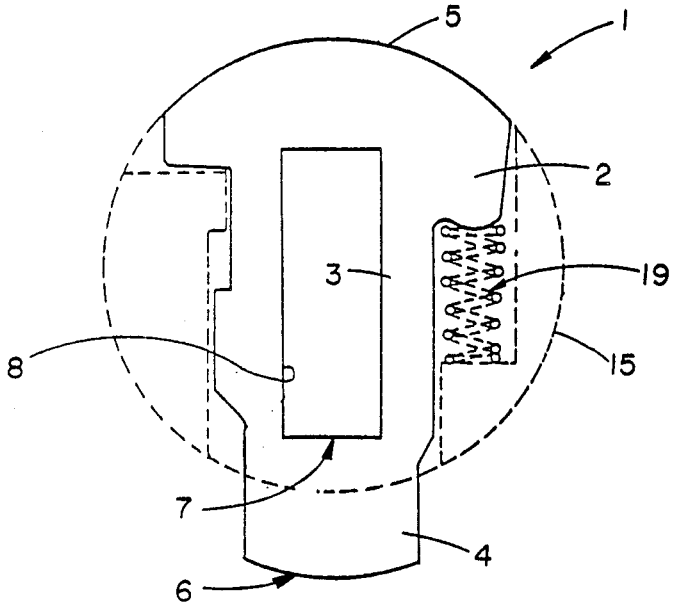
FIG. 2 is a similar view of the control tumbler of FIG. 1, with the control tumbler being displaced into an activated position by a removal key.

Referring now to the drawings and in particular to FIGS. 1 and 2, the control tumbler 1 is, preferably, metallic in construction and substantially T-shaped. The tumbler 1 includes an enlarged head (a first end) 2, a body 3 and (if desired) a straight tail (a second opposite end) 4. The shape of the edges 5 and 6 of, respectively, the head 2 and the tail 4 are rounded, having a curvature that substantially corresponds to the curvature of the diameter of the cylindrical barrel in which the tumbler 1 is slidingly positioned and whose section is represented by the dotted line 15.

It is noted that the width of the head 2 (that is—the width taken along the length of the tumbler) is greater than the width of the tail 4 or the body 3. This provides the head 2 of the tumbler 1 (which is the portion of the tumbler 1 which generates the greatest stress, especially during overturning or incorrect removing of the barrel encountered by the usage thereof) with an increased amount of surface area over which the stresses may be spread. In this fashion, the likelihood of deformation is reduced or avoided.

In a manner that is well known to those skilled in the art, the tumbler 1 is normally maintained in an eccentric position (a first resting position) represented in FIG. 1. Tumbler 1 is maintained in this resting position by a means for biasing the control tumbler to one of the two positions thereof, i.e., under the action of a spring 19. In this eccentric position, a large part of the head 2 projects outwardly (outside of) relative to the barrel.

An opening 8 is formed substantially centrally in the body 3 of the tumbler 1. When a normal key 12 is inserted into the barrel, the key 12 is received through this opening 8. When received through the opening 8, said key 12 either does not touch the edge 7, such that the control tumbler 1 remains in the resting position, or only slightly touches the edge 7, such that the control tumbler 1 is not completely removed from the resting position and/or slid into the second activated position (wherein the tumbler 1 is withdrawn into the diameter 15 of the body 16 of the barrel of the lock). Alternatively, when the extraction tool (in the form of a removal key 13) is introduced into the barrel, it is received through this opening 8, such that the removal key contact and collaborates with the lower edge 7 of the opening 8. This contact displaces (retracts) the tumbler 1 in the direction of, and over the area required for, placement of the tumbler 1 in the second activated position (figure 2). In this second activated position, the barrel assembly may be selectively removed from the housing, as will be fully discussed herein.

The positioning of the tumbler 1 in the activated position, wherein the removal of the barrel assembly from the housing is permitted, is represented in FIG. 2. In comparison with FIG. 1, it can be seen that the control tumbler 1 has been vertically displaced downwardly until the edge 5 of the enlarged head 2 at least coincides with, or is fully withdrawn into, the diameter of the barrel, as represented by the dotted line 15. In this fashion, in the activated position, the first end 2 of the tumbler 1 is retracted relative to the barrel 16.

Figure 3A:
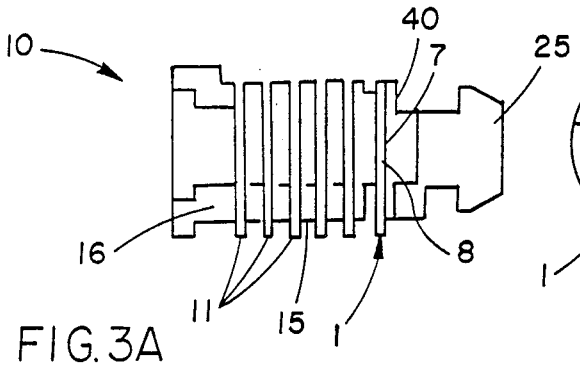
FIG. 3A is a longitudinal cross-section of the barrel of a lock of the present invention.
Figure 3B:
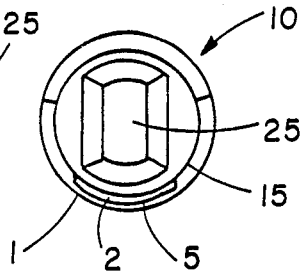
FIG. 3B is an end view of the barrel of the lock of FIG. 3A.

Reference is now made, in particular, to FIGS. 3A and 3B which illustrate, respectively, a longitudinal cross-section and an end view of the barrel of the lock having the control tumbler 1 of FIGS. 1 and 2.

The barrel assembly 10 including the body 16 is substantially cylindrical in shape having a curvature 15. The barrel assembly 10 is comprised of a body 16 and a plurality or series of sliding (combinating) tumblers 11. Tumblers 11 are disposed in the body 16 for sliding movement between respective first resting positions, wherein the rotation of the barrel assembly 10 in the housing is prevented, and second activating positions, wherein the rotation of the barrel 10 in the housing is permitted, in a manner that is well known to those skilled in the art.

It is also noted that the rearward portion of the barrel 16 includes a cut-out portion 40 that is formed therein, preferably, on the opposite side of the barrel 16 from where the head 2 extends therefrom.

The control tumbler 1, is slidably disposed in the body 16 being located behind (rearwardly of) the tumblers 11. The control tumbler 1 is further retained in the barrel 16 by mechanical means (not illustrated), that are also well known to those skilled in the art. Preferably, this tumbler 1 is thereby maintained in a position that is substantially eccentrically relative to the tumblers 11. In this position, at least a portion of the enlarged head 2 extends from the diameter (curvature) 15 of the barrel 16, as is perhaps most clearly represented in the end view (FIG. 3B). The curvature of the edge 5 of this enlarged part of the head 2 of the control tumbler 1 is, preferably, substantially identical to the curvature 15 (FIGS. 1 and 2) of the body 16 of the barrel assembly 10.

Figure 4A:
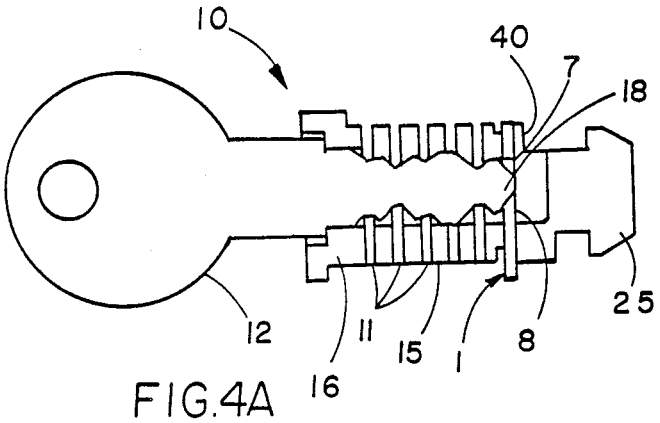
FIG. 4A is a longitudinal cross-section of the barrel of a lock of the present invention, with a normal key inserted therein.
Figure 4B:
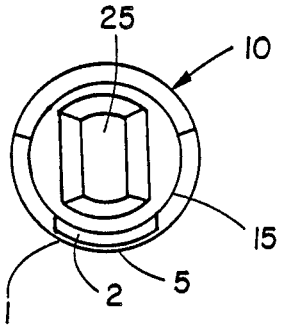
FIG. 4B is an end view of the barrel of the lock of FIG. 4A.

Reference is now made, in particular, to FIGS. 4A and 4B which illustrate, respectively, a longitudinal cross-section, and an end view corresponding thereto, of the barrel assembly 10 of a lock of the present invention, after the introduction (insertion) of a first normal key 12 having a first bitted portion into the barrel.

With the first bitted portion of the key 12 positioned in respective openings formed in the sliding tumblers 11, so as to contact edges thereof, at least a portion of the sliding tumblers 11 are returned (urged) to the respective activated positions thereof, in a manner known to those skilled in the art. As illustrated herein, these activated positions are retracted relative to the barrel, so that the tumblers 1 are positioned at the level of the diameter 15 of the body 16 of the barrel assembly 10. In this activated position, the rotation of the barrel assembly 10 is permitted for the locking and unlocking of the lock by use of the normal key 12.

Because the point 18 of the key 12 freely enters into the opening 8 of the control tumbler 1, so that said 12 key either does not touch the edge 7, or only slightly touches the edge 7 (such that the control tumbler 1 is not completely withdrawn into the body 16 of the barrel assembly 10 and slid into the activated position), the control tumbler 1 is not sufficiently displaced and substantially remains in the eccentric first resting position, as described above, and as is perhaps most clearly shown in the end view (FIG. 4B).

Figure 5A:
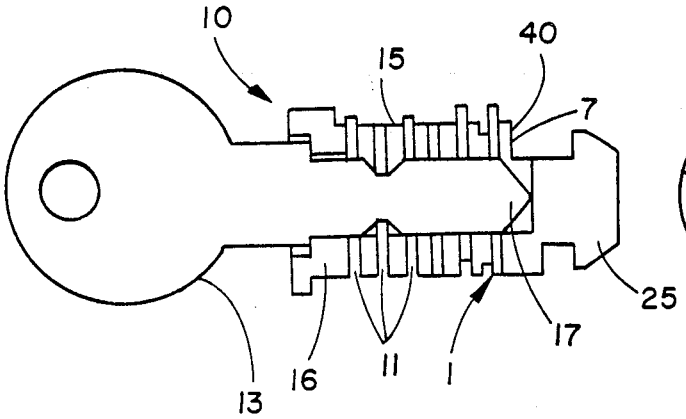
FIG. 5A is a longitudinal cross-section of the barrel of a lock of the present invention, with a removal key inserted therein.
Figure 5B:
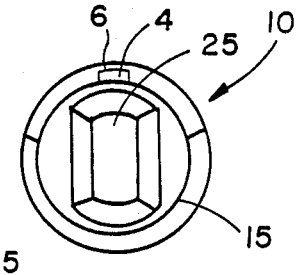
FIG. 5B is an end view of the barrel of the lock of FIG. 5A.

Reference is now made, in particular, to FIGS. 5A and 5B which illustrate, respectively, a longitudinal cross-section and an end view corresponding thereto, of the barrel assembly 10 of a lock according to the invention, after introduction of the extraction tool (a second removal key) 13.

The removal tool, represented and described here as a removal key 13 having simplified contours, is equipped with a second bitted portion. This bitted portion includes a point 17 which collaborates with the edge 7 of the opening 8 of the control tumbler 1. This collaboration between point 17 and the edge 7 slidingly displaces (retracts) the plate 1 inwardly relative to the body 16 (in FIGS. 5A and 5B in an upwardly direction) until the edge 5 of of the enlarged head 2 of the tumbler 1 is in the activated position, wherein the edge 5 at least coincides with the diameter 15 of the body 16 of the barrel assembly. Simultaneously, the straight part (the second opposite end) 4 of the tumbler 1 extends outwardly from (relative to) the opposite side of the diameter 15 of the body 16 of the barrel assembly 10, as is perhaps most clearly seen in the end view (FIG. 5B).

Because this removal key 13 does not possess the contours that are typical of the normal key 12, at least a portion of the tumblers 11 are not withdrawn into the respective activated positions thereof (which, as illustrated, are within the body 16 of the barrel). Thus, rotation of the barrel assembly 10 in the housing, such as is necessary for locking and unlocking of the lock by this key 13, is prevented.

Figure 6A:
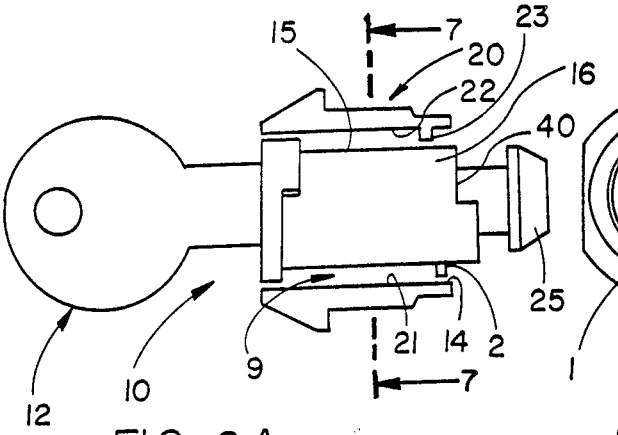
FIG. 6A is a longitudinal cross-section of the lock of the present invention, in a locked (closed) position and with the normal key inserted therein.
Figure 6B:
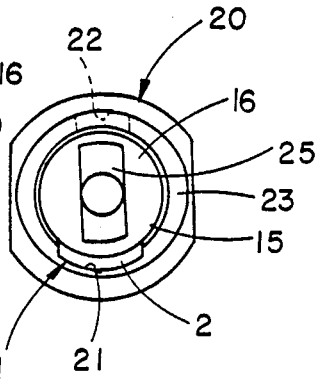
FIG. 6B is an end view of the lock of FIG. 5A.

Reference is now made, in particular, to FIGS. 6A and 6B which illustrate, respectively, a longitudinal cross-section, and an end view corresponding thereto, of a lock according to the present invention, wherein the lock is in the closed (locked) position, after the introduction of the normal key 12.

The housing 20 has a bore 9 formed therethrough for rotatably, removably receiving the barrel assembly 10 therein. The barrel 10 is retained in the housing 20 by the collaboration (abutment) of the enlarged head 2 of the control tumbler 1 of the present invention with a peripheral (annular) rim 23 that is formed or located in the bore 9. An internal longitudinal slot 21 is formed in the housing, so as to traverse the housing 20 extending from one end (a forward end) of the bore 9 of the housing 20 to the other. This slot 21 is in open communication with the bore formed through the housing 20. The width of this slot 21 is always less than the width of the enlarged head 2 of the control tumbler 1. In this fashion, when this enlarged head 2 is in the resting position, extending outwardly from the body 16 of the barrel assembly 10, it is received in an annular clearance space 14 that is located rearwardly of, and is in communication with, the slot 21, being defined behind this rim 23. Said annular clearance space 14 is sized to accomodate the extension of the first and/or second ends 2 and 4, respectively, of the tumbler 1. In this manner, removal of the barrel assembly 10 from the housing 20 is prevented, as is perhaps best seen in FIG. 6B. It is noted that, as is seen in FIGS. 6A and 6B, the slot 21 is also in communication with the annular clearance space 14.

A second internal longitudinal slot 22 also may be formed in the bore 9 of the housing 20 diametrically opposite of the slot 21. This second slot 22, like slot 21, extends rearwardly from the forward end of the bore 9 of the housing 20. Slot 22 is sized to accomodate the extension of various combinating tumblers 11 in their resting position. However, unlike slot 21, slot 22 terminates short of the annular clearance space 14, being separated therefrom by the rim 23.

Figure 7:
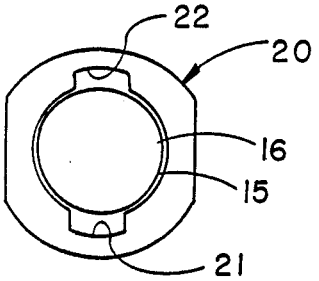
FIG. 7 is a transverse section of the lock of the present invention taken along line 7—7 of FIG. 6A.

FIG. 7 represents a traverse section of the lock according to the invention, taken along the line 7—7 of FIG. 6A, when the normal key 12 is inserted in the lock. The sliding tumblers 11 are always withdrawn (retracted) relative to the barrel into the activated position. As illustrated herein, this activated position of the tumblers 11 is the level of the body 16 of the barrel assembly 10. In this fashion, a free rotation of the barrel assembly for locking and unlocking the lock is permitted.

Figure 8A:
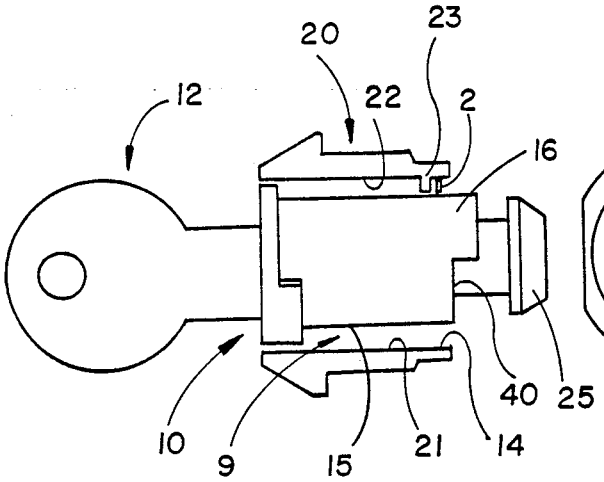
FIG. 8A is a longitudinal cross-section of the lock of the present invention, in an unlocked (open) position and with the normal key inserted therein.
Figure 8B:
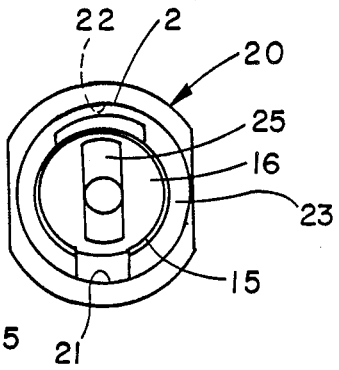
FIG. 8B is an end view of the lock of FIG. 8A.

Reference is now made, in particular, to FIGS. 8A and 8B which illustrates, respectively, a longitudinal cross-section view and an end view corresponding thereto, of the lock of the present invention in the unlocked (open) position, after the insertion therein of the normal key 12.

As discussed above with reference to FIGS. 4A and 4B, the first bitted portion of the normal key 12 does not contact the edge 7 of the control tumbler 1 sufficiently to move the tumbler 1 into the activated position in the body 16 of the barrel assembly 10, wherein the enlarged head 2 is withdrawn (retracted) relative to the diameter 15 of the barrel and into the activated position in the body 16 of the barrel assembly 10. Thus, the head 2 remains extended relative to the diameter 15 of the barrel in the resting position. In this resting position, wherein due to the width of the head 2 being greater than the width of the slot 21 (or slot 22), the head 2 abuts against rim 23 preventing the removal of the barrel assembly 10 from the housing 20 for the exchange or the replacement thereof. Thus, as shown in FIGS. 6A, 6B, 8A and 8B, with the normal key 12 the removal of the barrel assembly 10 is not possible, regardless of whether the lock is in the unlocked (open) position or in the locked (closed) position. Accordingly, the lock of the present invention necessitates the use of two separate keys to effectuate, respectively, the rotational movements (for effectuating the locking and unlocking functions) and the longitudinal movements (for effectuating the removal of the barrel assembly) thereof.

Figure 9A:
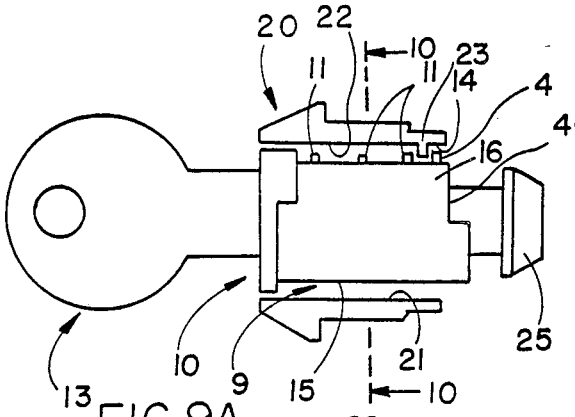
FIG. 9A is a longitudinal cross-section of the lock of the present invention, in the locked (closed) position after the removal key has been inserted therein.
Figure 9B:
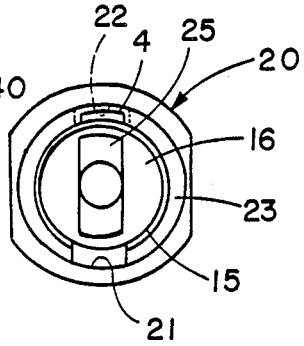
FIG. 9B is an end view of the lock of FIG. 9A.

Reference is now made, in particular, to FIGS. 9A and 9B which illustrate, respectively, a longitudinal cross-section and an end view corresponding thereto of the lock of the present invention, with the lock in the locked (closed) position, after the insertion therein of the removal key 13.

As discussed above with reference to FIGS. 5A and 5B, the contours of the bitted portion (the second bitted portion) of the removal key 13, do not correspond to those of the bitted portion (the first bitted portion) of the normal key 12. Thus, the contours of the bitted portion of the removal key 13 do not move at least a portion of the tumblers 11 into the respective activated positions thereof, wherein, as illustrated, the sliding tumblers 11 are drawn into the body 16 of the barrel assembly 10. Also, the tip 17 of this key 13 collaborates with the edges 7 of the central opening 8 of the control tumbler 1, as described above, displacing the tumbler 1 against the biasing force exercised by the spring 19 (see FIGS. 1 and 2). Such displacement simultaneously pushes the straight part 4 of the tumbler 1 outwardly from the opposite side of the barrel, such that the control tumbler 1 is slid into the activated position. Accordingly, and as can be seen when the key 13 is utilized with the lock in the locked position, this straight part 4 always remains retained behind the rim 23 and removal of the barrel assembly 10 in this locked (closed) position is prevented. Accordingly, the barrel assembly 10 can only be removed from the housing when the lock is in the unlocked position.

Figure 10:
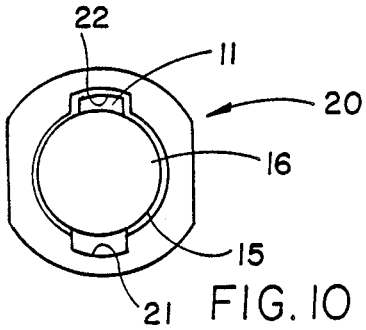
FIG. 10 is a transverse section of the lock taken along line 10—10 of FIG. 9A.

FIG. 10 is a traverse section of the lock, taken along line 10—10 of FIG. 9A. During use of the removal key 13, at least a portion of the sliding tumblers 11 are not slid into their respective activated positions (which, as illustrated, is a position wherein the tumblers 11 are withdrawn into the contours of the body 16 of the barrel assembly 10). Rather, this portion of the tumblers 11 remain in the resting position, (which, as illustrated, is a position wherein the tumblers 11 are protruding from the body 16 and 21 wherein they are accommodated). Thus, when key 13 is inserted, all rotation, in any direction, of the barrel assembly 10 in the housing 20 is prevented. Consequently, it remains impossible to either unlock (open) the lock, or to remove the barrel assembly 10 with the use of only the removal key 13. One must also resort to use of the normal key 12 to first unlock the lock in order to achieve this goal.

Figure 11A:
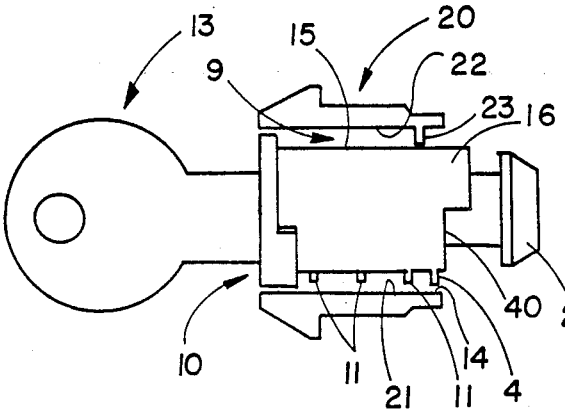
FIG. 11A is a longitudinal cross-section of the lock of the present invention, in the unlocked (open) position after the removal key has been inserted therein.
Figure 11B:
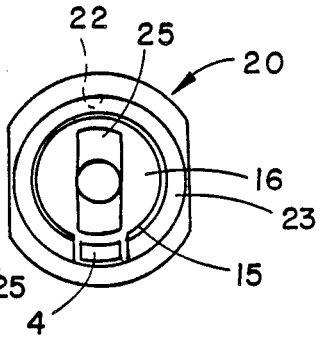
FIG. 11B is an end view of the lock of FIG. 11A.

Reference is now made, in particular, to FIGS. 11A and 11B which illustrate, respectively, a longitudinal cross-section and an end view corresponding thereto of the lock of the present invention with the barrel assembly in the unlocked (open) position after the insertion therein of the removal key 13.

After unlocking (opening) of the lock by the normal key 12 and removal of this key 12, the sliding tumblers 11 are urged by springs (biasing means which is not illustrated) out of the body 16 of the barrel assembly 10 and into the resting positions thereof. In the resting positions, tumblers 11 protrude (extend) into either groove 12 and/or groove 22 where they are accomodated.

Once introduced, the bitted portion of the removal key 13 moves (extends) at least a portion of the sliding tumblers 11 positions wherein they are at least partially protruding from the body 16. Further, insertion of the removal key 13 displaces (withdraws or retracts) the control tumbler 1, as described above, into the activated position thereof, wherein the head 2 at least coincides with the contour 15 of the body 16 of the barrel assembly 10, and further wherein the straight part 4 of the tumbler 1 is urged (extends) from the opposite side of the diameter 15 of the body 16 of the barrel assembly 10. Now that the barrel assembly 10 has been turned facing the groove 21, which extends traversely along the entire longitudinal length of the housing 20, the end 4 is received in the annular clearance space 14 located and defined behind the peripheral rim 23 (which serves as a stop in the other position of the barrel 10). Because the width of the straight part 4 of the tumbler 1 is less than that of the groove 21, (and that of the head 2), the extension of the end 4 is accomodated in the groove 21 and the barrel assembly 10 is no longer retained in the housing by any mechanical means. Thus, the barrel assembly 10 is able to be easily longitudinally slidably removed from the housing 20 simultaneously with the removal key.

Figure 12A:
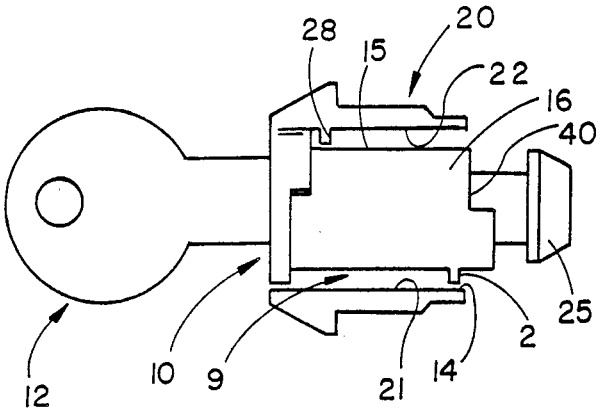
FIG. 12A is a longitudinal cross-section of another embodiment of the lock of the present invention.
Figure 12B:
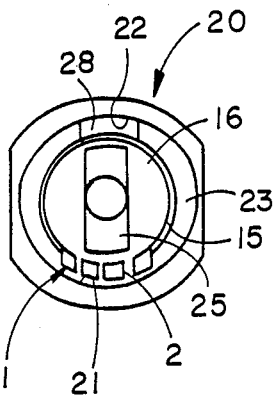
FIG. 12B is an end view of the lock of FIG. 12A.
Figure 12C:
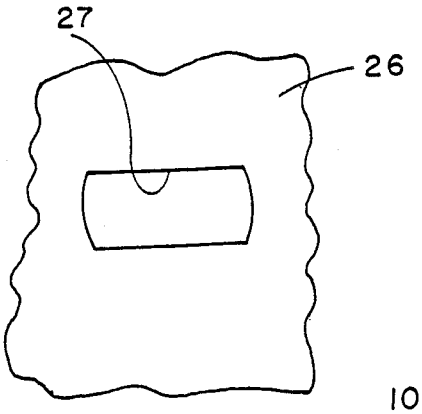
FIG. 12C is an elevated view of a retaining surface for the lock of FIGS. 12A and 12B.

For certain realizations, it is difficult to form or place a rim 23 in the bore 9 and across the slot 22, such as described in FIGS. 6A and 6B. In such an event, an alternate mode of realization can be utilized in which a forward rim 28 is formed at the entrance (in the forward end or portion) of the housing 20 extending across the slot 22, so that the forward portion of the slot 22 is closed, as is seen in FIGS. 12A and 12B. With this arrangement, when the lock is in the locked position, the total removal of the barrel assembly 10 will still be prevented by the abutment of the tumblers 1 and/or 11 with the rim 28. In these cases, in order to prevent even the partial removal of the assembly 10 from the housing 20, it is especially applicable to provide another mechanical means of supplementary retention of the barrel assembly 10 in the housing 20, for example, using the form of a retaining surface 26, as is represented in FIGS. 12C, D, E and F, having a particular oblong-shaped opening 27 formed therein.

The lug 25 of the barrel assembly 10 is realized as shown in FIG. 12A. Lug 25 is associated with the body 16 of the barrel assembly 10 for concomitant rotational and longitudinal movement therewith. Lug 25 is formed having a substantially oblong shape and is sized so that, in a first position, the lug 25 may be passed or be received through the opening 27 for removal of the barrel assembly 10 from the housing 20. Lug 25 is further sized and shaped, so that in a second position, the lug 25 is prevented from being passed or being received through the opening 27, whereby the barrel assembly 10 is retained in the housing 20. The housing 20 is formed such that the longitudinal groove 21 traverses substantially the entire length of the bore 9 of the housing 20, while the groove 22 is, preferably, closed at the forward end (the entrance) of the housing 20 by the rim 23.

In the locking and/or unlocking positions, the enlarged part 2 of the tumbler 1, which has a width being greater than the width of either of the longitudinal grooves 21 and 22 of the housing 20, is in the resting position being extended outwardly relative to the body 16, as, for example, is represented in the corresponding end view of FIG. 12B. Thus, when the head 2 abuts the rim 23. In this fashion, removal of the barrel assembly 10 from the housing 20 with the normal key 12 is prevented.

Figure 12D:
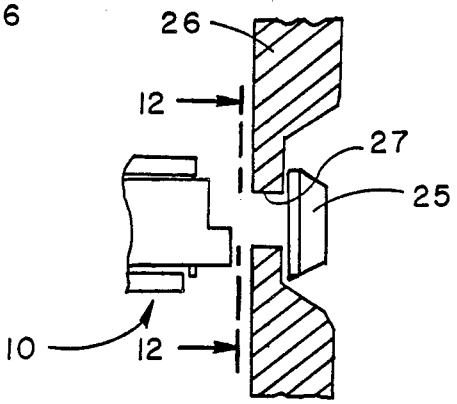
FIG. 12D is a longitudinal section of the retaining surface and lug illustrating the mechanical retaining means of the lock of FIGS. 12A–12C.
Figure 12E:
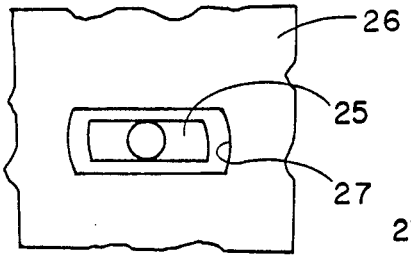
FIG. 12E is an elevated end view of the retaining surface and lug of the lock of FIGS. 12A–12C with the lock in the unlocked (open) position taken along line 12—12 of FIG. 12D.
Figure 12F:
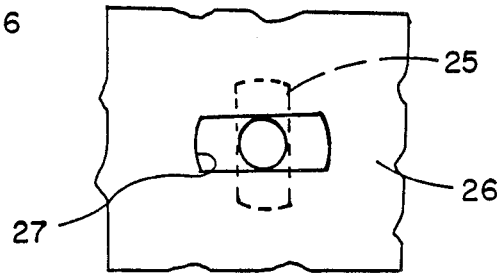
FIG. 12F is an elevated end view of the retaining surface and lug of the lock of FIGS. 12A–12C with the lock in the locked (closed) position taken along line 12—12 of FIG. 12D.

In the locking position (FIG. 12F), the lug 25 behind the body 16 of the barrel assembly 10 is retained by the retaining surface 26, as is shown in FIGS. 12D and 12F.

In the unlocking position, as is represented in FIG. 12E, the lug 25 is aligned with the opening 27 of the retaining surface 26. This allows the lug 25 to be uncoupled from the retaining surface 26, thereby permitting the barrel assembly 10 and the control tumbler 1 to be longitudinally removed from the housing 20.

For the removal and replacement of the barrel assembly 10 of a lock according to this mode of realization, first, the normal key 12 is introduced to unlock the lock. Then, using the removal key 13, the ensemble, including the housing 20, the barrel assembly 10 and the tumblers 1 and 11, is separated form the retaining surface 26. The barrel may then returned to the locking position with use of the normal key 12. Alternatively, the removal key 13 may be inserted into the barrel assembly 10 for removing the barrel 10 from the housing 20 for, i.e., replacement thereof by another barrel assembly 10.

Figure 13:
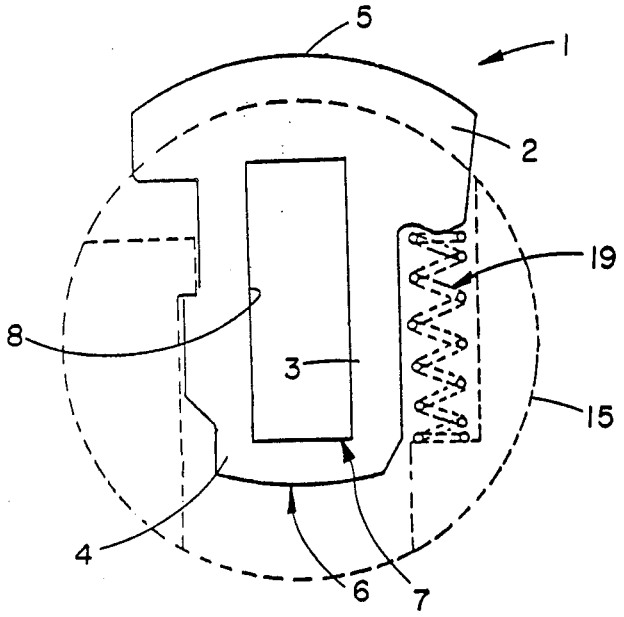
FIG. 13 is an elevated view of another control tumbler of the present invention in the resting position.
Figure 14:
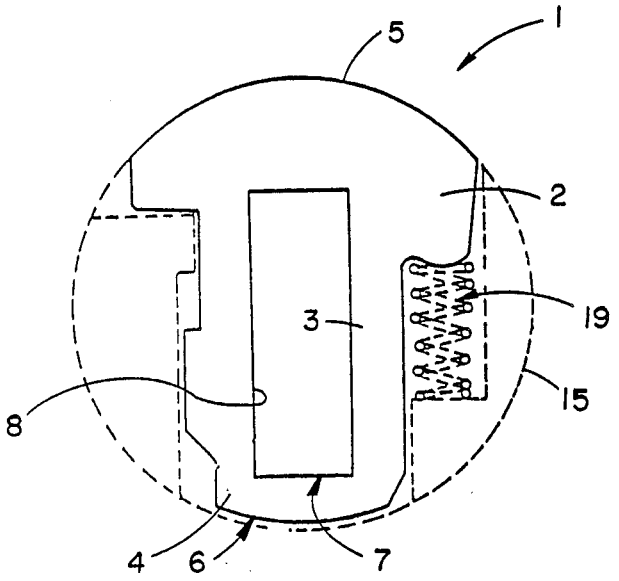
FIG. 14 is a similar view of the control tumbler of FIG. 13, the control tumbler in the activated position.

Referring now to FIGS. 13 and 14, it can be seen that, if desired, the control tumbler 1 may be formed so that, if it is provided with a second end 4, then the said second end 4 would always be withdrawn (retracted) relative to the barrel, regardless if the tumbler 1 is in the resting (FIG. 13) or the activated (FIG. 14) positions thereof. As can be seen in FIGS. 13 and 14, when a second end 4 is provided, the height of the sliding control tumbler 1 is substantially less than the diameter (being either equal to or less than the diameter) of the barrel. In such an event, it is noted that the slots 21 and 22 need not extend all the way to, or be in communication with, the annular clearance space 14, since there are no portions of the tumbler 1 which extend from the body 16 of the barrel assembly 10 when the tumbler 1 is in the activated position. In this fashion, the construction of the barrel assembly 10 can be greatly simplified and problems with manufacturing standardization are minimized or eliminated.

It is further noted that, with the exception of the positioning and activities of the tail 4, the operation of this control tumbler 1 seen in FIGS. 13 and 14 is identical to those of the control tumbler 1 illustrated and described in FIGS. 1 and 2 (and the remaining Figures). However, it is further noted that this arrangement has a drawback not found with the control tumbler 1 illustrated in FIGS. 1 and 2. This drawback is that since the second end 4 of the control tumbler 1 does not extend therefrom in the activated position, then in the arrangements shown above, the barrel assembly 10 may be removed from the housing 20, even when the barrel assembly 10 is in the locked position. In order to solve this problem, the locks of the present invention which have such an one-ended control tumbler 1 include therewith secondary mechanical retaining means for retaining the barrel assembly 10 in the housing 20 when the barrel assembly 10 is in its locked position. Examples of such locks, and the secondary mechanical retaining means provided therefor, are shown in two of the many environments in which these locks are to be used, that is, in combination with a box carrier 30 and in combination with a foot 50 of a load carrier.

Figure 15:
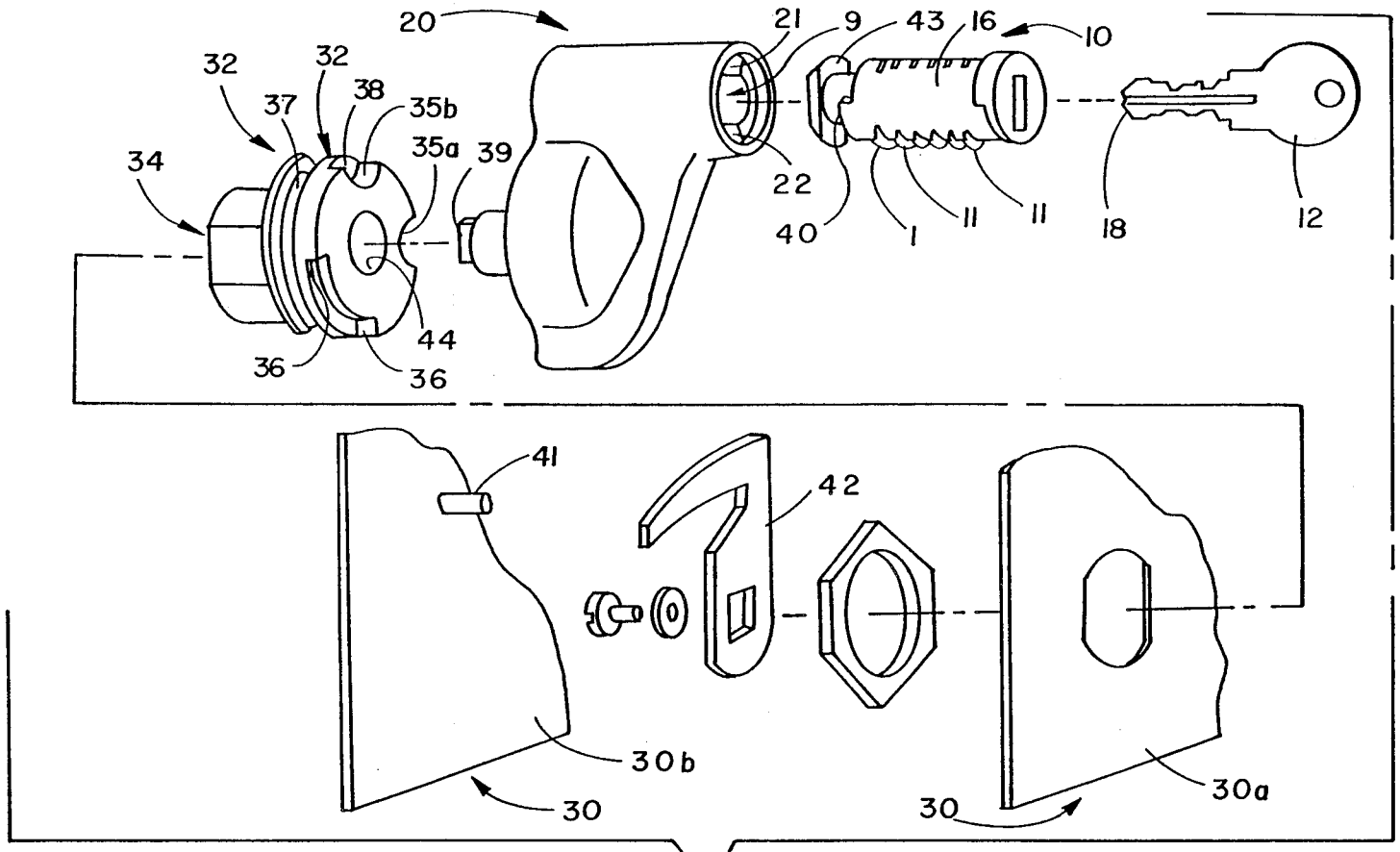
FIG. 15 is an exploded perspective view of the lock of the present invention having the control tumbler of FIGS. 13 and 14 adapted for use in a box carrier.
Figure 16:
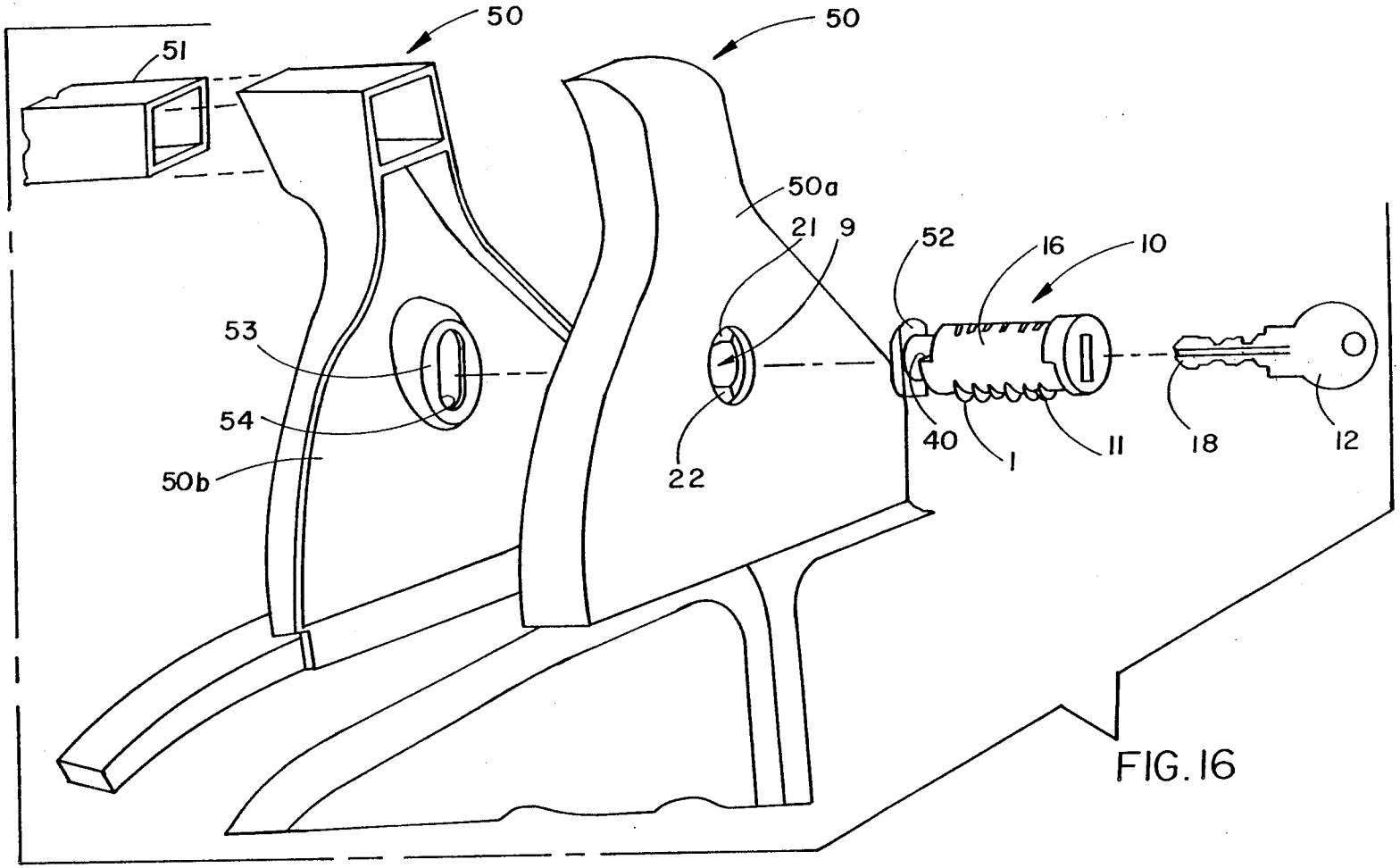
FIG. 16 is an exploded perspective view of the lock of the present invention having the control tumbler of FIGS. 13 and 14 adapted for use in the foot of a load carrier.

With reference now to FIGS. 15 and 16, the lock having the control tumblers 1 of the present invention are illustrated in combination with, respectively, a box carrier 30 and the foot 50 of a load carrier. With the exception of the mechanical retaining means, these locks are similar in construction and operation to those described above with reference to FIGS. 3–14. In this respect, the lock (and the barrel assembly 10 thereof) is formed, as was described above with reference to FIGS. 3–12, with the exception that it includes therein the control tumbler described in FIGS. 13 and 14.

In addition to the features already mentioned, the lock of FIG. 15 further includes a ring member (commonly referred to by those skilled in the art as a "rose") 32. Ring member 32 has a first end 33 that is supported by a first support **30*a*, which is usually a door 30*a* of the box carrier 30. The ring member 32 further has a second opposite end 34. This second opposite end 34 has at least two peripherally-spaced arcuate notches 35*a* and 35*b* formed therein. Each of said notches 35*a* and 35*b* has a curvature that is substantially identical to the curvature 15 of the body 16 of the barrel. If desired, the second opposite end 34 may also have stops 36 positioned or formed thereon, whereby the pivoting movement of the housing 20 (as shall be discussed later) is limited. Finally, the ring member 32 has a peripheral groove 37 formed therein between the first end 33 and the second end 34 of the ring member 32. Positioned in this manner, this peripheral groove 37 is in open communication with at least one of the arcuate notches 35*a* and a shoulder 38 is defined between the peripheral groove 37 and the other arcuate notch 35*b***.

The housing 20 includes a rearwardly extending rod or bolt 39 that is situated on a longitudinal axis being substantially parallel to, but offset from, the longitudinal axis of the bore 9 of the housing 20. This rod 39 is received through a bore 44 formed through the ring member 32, such that the housing 20, bore 9 and barrel assembly 10 are all supported by the ring member 32 for pivotal movement about the ring member 32 between a first closed (locking) position and a second open (unlocking) position. The housing 20 is thus pivotably supported by the ring member 32 with a rearward portion of the barrel (a portion of the body 16 of the barrel located substantially rearwardly of the control tumbler 1) being registry with the periphery of the ring member 23.

Positioned as described above, when the housing 20 is pivoted into the first locking position, the cut-out 40 of the barrel (which is located substantially rearwardly of and, preferably, opposite to the first end 2 of the control tumbler 1) is, preferably, oriented away from the notches 35*a* and 35*b*, such that a portion of the body 16 of the barrel is received in either of the notches 35*a* or 35*b*. In this position, the pivoting of the housing 20 between the first closed and the second open positions thereof is prevented. When the cut-out is oriented facing (aligned with) the notches 35*a* or 35*b*, such that the barrel 16 and the ring member 32 "clear" one another and the housing 20 may be pivoted into the second open position. In this position, the pivoting of the housing 20 between the first closed position and the second open position is permitted.

An enlarged lug 43 is associated (is integral with) the rearward portion of the body 16 of the barrel (in the same manner as lug 25, described above) for concomitant rotational movement therewith between the locking and unlocking positions of the barrel assembly 10. It is noted that the size and shape of the lug 43 permits the lug 43 to be received in the peripheral groove 37 of the ring member 32. In the unlocking position, the lug 43 is received in this groove 37 aligned with one of the arcuate notches 35*a*, so that longitudinal removal of the barrel assembly 10 is permitted. Alternatively, in the locking position, the lug 43 is received in the groove 37 aligned with the other of the arcuate notches 35*b*, so that the shoulder 38 therebetween prevents the longitudinal removal of the lug 43 and the barrel assembly 10 from the housing 20.

The secondary mechanical retaining means is provided in the form of a latch member/catch means arrangement. In this arrangement, a catch means 41 for coacting with a latch member 42 is positioned on a second support 30*b*, which in the present embodiment, is usually a wall 30*b* of the box carrier 30. A latch member 42, located rearwardly of the housing 20, is secured to (associated with) the rod 39 at a position being opposite from the housing 20 for concomitant pivotal movement with the housing 20 between the locked and the unlocked positions of the housing. In this manner, in the locking position of the housing, the latch member 42 is pivoted into contact with the catch means 41, so that the catch means 41 catches and coacts with the latch member 42, thereby preventing the separation of the first and second supports 30*a* and *b*, respectively, locking the box 30 and preventing access to the contents thereof. In this unlocking position of the housing 20, the latch member 42 is pivoted out of contact with the catch means 41, so that they are spaced from one another, thereby permitting the separation of the first and second supports 30*a* and 30*b*, unlocking the box 30 and providing access to the contents thereof.

In addition to the features already mentioned, the lock of FIG. 16 includes a different mechanical retaining means for retaining the barrel assembly 10 in the housing 20 when the barrel assembly 10 is in its locked position. This arrangement finds special applicability when the lock is being utilized in combination with a load carrier of the type having framework feet 50 and bars 51 that are removably secured thereto, as seen in FIG. 16. In these arrangements, a portion 50*a* of each foot 50 is removable from the remainder 50*b* of the foot 50, so that installation and removal of the bars 51 is permitted.

Unlike the locks described above, if desired, in this environment the removable portion 50*a* of the foot 50 may serve as the housing having the bore 9, slots 21 and 22 and clearance spaces 14 formed therein in the same manner as was described at length above.

Each of the remainder portions 50*b* of the feet 50 (that portion which is usually secured to the motor vehicle) has a respective retaining surface 53, including an opening 54 formed therein. Each of these remainder portions 50*b* is positioned substantially rearwardly of a respective removeable portion 50*a* of a foot 50.

Like the locks described above, a lug 52 is associated (is integral with) the rearward portion of the body 16 of the barrel for concomitant rotational movement therewith between the locking and unlocking positions of the barrel assembly 10. The size and shape of the lug 52 permits it to be received in a respective opening 54 of the retaining surfaces 53. In the unlocking position, the lug 52 freely passes through this opening 54, whereby longitudinal removal of the barrel assembly 10 from the retaining surfaces 53 is permitted and the portions 50*a* and 50*b* of the feet 50 are able to be removed from one another. In this manner, access is provided to the interior of the feet 50 for removal and installation of the bars 51. Alternatively, in the locking position, the lug 52 is prevented from passing through the respective openings 54 in the retaining surfaces 53 and the feet 50. In this fashion, the longitudinal removal of the lug 52 and the barrel assembly 10 from the foot 50 of the load carrier is prevented and the portions 50*a* ad 50*b* of the load carriers are prevented from being separated from one another. Thus, access to the interior of the feet 50 is denied, so that the installation and removal of the bars 51 is prevented.

Having thus described the present invention, it will be understood by those skilled in the art that, within the scope of the appended claims, the invention may be practiced other than has been specifically described herein. For example, if desired, the functions of the normal key 12 and the removal key 13 may be combined into a single common key by extending and forming the tip 18 of the key 12, so that it is in the same shape as the tip 17 of the key 13. However, in such a case, the barrel assembly 10 may be subject to undesired removal during the locking and unlocking rotational movement thereof and vice versa.

What is claimed is:

1. In combination with a load carrier of the type having a framework including feet and bars that are removably secured thereto, wherein a portion of each of the feet is removable from the remainder thereof for permitting installation and removal of the bars, a key-activated removable cylinder lock, comprised of:

respective lock barrels, each of the lock barrels including a respective plurality of sliding combinating tumblers disposed therein for movement between respective first resting positions and respective second activated positions, each of the barrels further including a respective sliding control tumbler having a first end and a second end, the control tumblers being disposed in the respective barrels for movement between respective first resting position, wherein the first ends are extended relative to the barrels, and respective second activated positions, wherein the first ends are retracted relative to the barrels;

respective means for biasing each of the control tumblers to one of the two respective positions thereof;

each of the removable portions of the feet having a respective bore formed therethrough for rotatably receiving one of the barrels therein, the removable portions further having a respective internal longitudinal slot formed therein extending from a forward end of the bore and being in open communication with the bore, each of the feet further including a respective annular clearance space located rearwardly of the slot for accomodating extension of the first end of one of the respective control tumblers in the resting position portions is permitted between the locking positions of the barrels, so that the portions of the feet are secured to one another preventing removal of the bars from the feet, and further between the unlocking positions of the barrels, so that the portions of the feet are unsecured from one another permitting removal of the removable portions of the feet from remainder thereof, whereby access to the bars for installation to and removal from the feet is permitted;

such that when the respective barrels are disposed in the feet with at least a portion of the combinating tumblers in the respective resting positions thereof, said combinating tumblers are received in the respective slots preventing rotational movement of the barrels in the feet for the locking and unlocking thereof;

the width of the first end of each of the control tumblers being greater than the width of the respective slots, such that the slots do not accomodate the said first ends, whereby when the control tumblers are in the respective resting positions, removal of the barrels from the feet are prevented; and wherein insertion of a key into the barrels slidingly moves the control tumblers into the activated positions thereof permitting removal of the barrels from the feet.

2. The combination load carrier including feet and bars, and the key-activated removable cylinder lock of claim 1, further comprised of:

each of the remainder portions of the respective feet having a respective retaining surface positioned rearwardly of the removable portion of the feet, each of said retaining surfaces having an opening formed therethrough;

the barrels having a respective forward portion and a respective rearward portion;

a respective lug associated with each of the rearward portions of the barrels for concomitant rotational movement therewith between locking and unlocking positions, said lugs being sized and shaped, so that when in the unlocking positions the lugs freely pass through the respective openings in the retaining surfaces, whereby the barrels may be removed from the retaining surfaces of the feet and the portions of the feet are permitted to be removed from one another, such that access is provided for installation and removal of the bars, and further so that when in the locking positions, the lugs are prevented from passing through the respective openings in the retaining surfaces, whereby the barrels are attached to the respective retaining surfaces, preventing removal of the barrels from the retaining surfaces and the feet when the barrels are in the locking positions thereof, and further preventing the portions of the feet from being separated from one another and the bars from being removed from the feet.

3. In combination with a storage box having a first support surface and a second support surface, a key-activated removable cylinder lock for selectively securing the first and second support surfaces to one another, whereby the storage box is locked for preventing access thereto, and for selectively unsecuring the first and second support surfaces from one another, whereby the box is unlocked for permitting access thereto, the combination comprised of:

a lock barrel including a plurality of sliding combinating tumblers disposed in the barrel for movement between respective first resting positions and respective second activated positions, the barrel further including a sliding control tumbler having a first end and a second end, the control tumbler being disposed in the barrel for movement between a first resting position, wherein the first end is extended relative to the barrel, and a second activated position, wherein the first end is retracted relative to the barrel;

means for biasing the control tumbler to one of the two positions thereof;

a housing having a bore formed therethrough for rotatably receiving the barrel therein, the housing further having an internal longitudinal slot formed therein extending from a forward end of the housing and being in open communication with the bore, the housing including an annular clearance space located rearwardly of the slot for accomodating extension of the first end of the control tumbler in the resting position thereof, whereby rotational movement of the barrel in the housing between a first locking position and a second unlocking position is permitted;

such that when the barrel is disposed in the housing with at least a portion of the combinating tumblers in the respective resting positions thereof, said combinating tumblers are received in the slot preventing rotational movement of the barrel in the housing for the locking and unlocking thereof;

the width of the first end of the control tumbler being greater than the width of the slot, such that the slot does not accomodate the first end, whereby when the control tumbler is in the resting position, removal of the barrel from the housing is prevented;

wherein insertion of a key into the barrel slidingly moves the control tumbler into the activated position permitting removal of the barrel from the housing;

the barrel having a curvature;

a ring member having a first end supported by the first support surface and a second opposite end having at least two peripherally-spaced arcuate notches formed therein, each of said notches having a curvature being substantially identical to the curvature of the barrel;

the ring member further having a peripheral groove formed therein between the first end and the second end, the peripheral groove being in open communication with one of the arcuate notches and whereby a shoulder is defined between the peripheral groove and the other arcuate notch;

the housing being pivotably carried by the ring member at a position being offset relative to the bore of the housing, whereby the housing, the bore and the barrel are supported by the ring member for pivotal movement about the ring member with a portion of the barrel being in registry with the periphery of the ring member between a respective first closed position and a respective second open position;

the barrel further having a cut-out formed therein, such that when the barrel is in the first locking position thereof, a portion of the barrel is received in an arcuate notch, thereby preventing pivoting of the housing between the respective closed and open positions thereof, and further such that when the barrel is in the second unlocking position thereof, the cut-out formed in the barrel is aligned with either one of the arcuate notches, thereby permitting the pivoting of the housing between the respective closed and open positions thereof;

catch means for coacting with a latch member, said catch means being positioned on a second support;

a latch member located rearwardly of the housing and associated therewith for concomitant pivotal movement therewith between the first closed position and the second open position of the housing, wherein in the closed position of the housing, the catch means catches and coacts with the latch member, thereby preventing the separation of the first and second support surfaces and further wherein in the open position of the housing, the catch means and the latch member are spaced from one another, thereby permitting the separation of the first and second support surfaces and permitting access to the box; and a lug associated with the rearward portion of the barrel for concomitant rotational movement therewith between the locking and unlocking positions of the barrel, said lug being sized and shaped, so that when in the open position of the housing, the lug is received in the peripheral groove of the ring member aligned with the one of the arcuate notches, so that longitudinal removal of the lug with the barrel is permitted, and further so that when in the closed position of the housing, the lug is received in the peripheral groove of the ring member aligned with the other arcuate notch, such that the shoulder therebetween prevents longitudinal removal of the lug and the barrel from the housing.

4. In combination with a storage box having a first support surface and a second support surface, a key-activated removable cylinder lock for selectively securing the first and second support surfaces to one another, whereby the storage box is locked for preventing access thereto, and for selectively unsecuring the first and second support surfaces from one another, whereby the box is unlocked for permitting access thereto, the combination comprised of:

a lock barrel including a plurality of sliding combinating tumblers disposed in the barrel for movement between respective first resting positions and second activated positions, the barrel further including a sliding control tumbler having a first end and a second end, the control tumbler being disposed in the barrel for movement between a first resting position, wherein the first end is extended relative to the barrel, and a second activated position, wherein the first end is retracted relative to the barrel;

means for biasing the control tumbler to one of the two positions thereof;

a housing having a bore formed therethrough for rotatably receiving the barrel therein, the housing further having an internal longitudinal slot formed therein extending from a forward end of the housing, the housing including an annular clearance space located rearwardly of the slot for accomodating extension of the first end of the control tumbler in the resting position thereof, whereby rotational movement of the barrel between a first locking position and a second unlocking position in the housing is permitted;

such that when the barrel is disposed in the housing with at least a portion of the combinating tumblers in the respective resting positions thereof, said combinating tumblers are received in the slot preventing rotational movement of the barrel in the housing for the locking and unlocking thereof;

the width of the first end of the control tumbler being greater than the width of the slot, such that the slot does not accomodate the first end, whereby when the control tumbler is in the resting position, removal of the barrel from the housing is prevented; and wherein insertion of a key into the barrel slidingly moves the control tumbler into the activated position permitting removal of the barrel from the housing;

the barrel having a curvature;

a ring member having a first end supported by the first support surface and a second opposite end having at least two peripherally-spaced arcuate notches formed therein, each of said notches having a curvature being substantially identical to the curvature of the barrel;

the ring member further having a peripheral groove formed therein between the first end and the second end, the peripheral groove being in open communication with one of the arcuate notches, and whereby a shoulder is defined between the peripheral groove and the other arcuate notch;

the housing being pivotably carried by the ring member at a position being offset relative to the bore of the housing, whereby the housing, the bore and the barrel are supported by the ring member for pivotal movement about the ring member with a portion of the barrel being in registry with the periphery of the ring member between a respective first closed position and a respective second open position;

the barrel further having a cut-out formed therein, such that when the barrel is in the first locking position thereof, a portion of the barrel is received in an arcuate notch, thereby preventing pivoting of the housing between the respective closed and open positions thereof, and further such that when the barrel is in the second unlocking position thereof, the cut-out formed in the barrel is aligned with either one of the arcuate notches, thereby permitting the pivoting of the housing between the respective closed and open positions thereof;

means formed between the second support surface and the housing and associated therewith for selectively securing and unsecuring the first and second support surfaces, such that pivotal movement of the housing into the first closed position secures the first and second support surfaces to one another, whereby the box is closed for preventing access thereto, and further such that pivotal movement of the housing into the second open position unsecures the first and second support surfaces from one another, whereby the box is open for permitting access thereto; and a lug associated with the rearward portion of the barrel for concomitant rotational movement therewith between the locking and unlocking positions of the barrel, said lug being sized and shaped, so that when in the open position of the housing, the lug is received in the peripheral groove of the ring member aligned with the one of the arcuate notches, so that longitudinal removal of the lug with the barrel is permitted, and further so that when in the closed position of the housing, the lug is received in the peripheral groove of the ring member aligned with the other arcuate notch, such that the shoulder therebetween prevents longitudinal removal of the lug and the barrel from the housing.

5. In combination with a structure having a first support surface and a second support surface, a key-activated removable cylinder lock for selectively securing and unsecuring the first and second support surfaces to one another, the combination comprised of:

a lock barrel including a plurality of sliding combinating tumblers disposed in the barrel for movement between respective first resting positions and second activated positions, the barrel further including a sliding control tumbler having a first end and a second end, the control tumbler being disposed in the barrel for movement between a first resting position, wherein the first end is extended relative to the barrel, and a second activated position, wherein the first end is retracted relative to the barrel;

means for biasing the control tumbler to one of the two positions thereof;

a housing having a bore formed therethrough for rotatably receiving the barrel therein, the housing further having an internal longitudinal slot formed therein extending from a forward end of the housing, the housing including an annular clearance space located rearwardly of the slot for accomodating extension of the first end of the control tumbler in the resting position thereof, whereby rotational movement of the barrel between a first locking position and a second unlocking position in the housing is permitted;

such that when the barrel is disposed in the housing with at least a portion of the combinating tumblers in the respective resting positions thereof, said combinating tumblers are received in the slot preventing rotational movement of the barrel in the housing for the locking and unlocking thereof;

the width of the first end of the control tumbler being greater than the width of the slot, such that the slot does not accomodate the first end, whereby when the control tumbler is in the resting position, removal of the barrel from the housing is prevented; and wherein insertion of a key into the barrel slidingly moves the control tumbler into the activated position permitting removal of the barrel from the housing;

the barrel having a curvature;

a ring member having a first end supported by the first support surface and a second opposite end having at least two peripherally-spaced arcuate notches formed therein, each of said notches having a curvature being substantially identical to the curvature of the barrel;

the ring member further having a peripheral groove formed therein between the first end and the second end, the peripheral groove being in open communication with one of the arcuate notches, and whereby a shoulder is defined between the peripheral groove and the other arcuate notch;

the housing being pivotably carried by the ring member at a position being offset relative to the bore of the housing, whereby the housing, the bore and the barrel are supported by the ring member for pivotal movement about the ring member with a portion of the barrel being in registry with the periphery of the ring member between a respective first closed position and a respective second open position;

the barrel further having a cut-out formed therein, such that when the barrel is in the first locking position thereof, a portion of the barrel is received in an arcuate notch, thereby preventing pivoting of the housing between the respective closed and open positions thereof, and further such that when the barrel is in the second unlocking position thereof, the cut-out formed in the barrel is aligned with either one of the arcuate notches, thereby permitting the pivoting of the housing between the respective closed and open positions thereof;

means formed between the second support surface and the housing and associated therewith for selectively securing and unsecuring the first and second support surfaces, such that pivotal movement of the housing into the first closed position secures the first and second support surfaces to one another, and further such that pivotal movement of the housing into the second open position unsecures the first and second support surfaces from one another;

a lug associated with the rearward portion of the barrel for concomitant rotational movement therewith between the locking and unlocking positions of the barrel, said lug being sized and shaped, so that when in the open position of the housing, the lug is received in the peripheral groove of the ring member aligned with the one of the arcuate notches, so that longitudinal removal of the lug with the barrel is permitted, and further so that when in the closed position of the housing, the lug is received in the peripheral groove of the ring member aligned with the other arcuate notch, such that the shoulder therebetween prevents longitudinal; removal of the lug and the barrel from the housing.

* * * * *